US005860403A

United States Patent [19]

Hirano et al.

[11] Patent Number: 5,860,403

[45] Date of Patent: Jan. 19, 1999

[54] SYSTEM FOR PRODUCING LUBRICATING OIL MIST IN ENGINE

[75] Inventors: Tomohiro Hirano; Yasutake Ryu; Shinji Katayama; Mitsuo Shiga, all of Wako, Japan

[73] Assignee: Honda Giken Kogyo Kagushiki Kaisha, Tokyo, Japan

[21] Appl. No.: 874,658

[22] Filed: Jun. 13, 1997

[30] Foreign Application Priority Data

Oct. 9, 1996 [JP] Japan ..... 8-268469

[51] Int. Cl.[6] ..... F01M 1/06

[52] U.S. Cl. ..... 123/196 R; 123/196 W; 184/6.18; 184/11.1

[58] Field of Search ..... 123/196 R, 196 W; 184/6.2, 6.18, 6.26, 11.1

[56] References Cited

U.S. PATENT DOCUMENTS 1,112,975 10/1914 Brush ..... 123/196 W
1,291,157 1/1919 Robson ..... 184/11.1
4,790,273 12/1988 Oguri et al. ..... 123/196 W
5,312,192 5/1994 Shimuzu et al. ..... 384/471
5,588,408 12/1996 Kurihara ..... 123/196 W

*Primary Examiner*—Henry Yuen
*Assistant Examiner*—Hai H. Huynh
*Attorney, Agent, or Firm*—Armstrong, Westerman, Hattori, McLeland & Naughton

[57] ABSTRACT

An oil reservoir chamber 22 in an engine E is formed into a tubular shape having annular corner portions 22*a* and 22*b* at opposite ends, and an oil slinger 25 is secured to a crankshaft 13 and has two splashing blades 25*a* and 25*b* with their tip ends being in proximity to the corner portions 22*a* and 22*b*, so that a lubricating oil in the oil reservoir chamber 22 is splashed by at least one of the two splashing blades 25*a* and 25*b* during rotation of the oil slinger 25 with any operative position of the engine E. Thus, a lubricating oil mist can be produced with any operative position of the engine E by the oil slinger of a simple structure including the two blades.

5 Claims, 12 Drawing Sheets

SYSTEM FOR PRODUCING LUBRICATING OIL MIST IN ENGINE

BACKGROUND OF THE INVENTION

1. Field of the Invention

The present invention relates to a system for producing a lubricating oil mist in an engine, which is designed so that an oil mist for lubricating the inside of the engine is produced by splashing an lubricating oil in an oil reservoir chamber provided in an engine body.

2. Description of the Related Art

The applicant of this application has already proposed a system for producing a lubricating oil mist in an engine, including an oil reservoir chamber provided in an engine body, and an oil slinger secured to a crankshaft or a rotary shaft operatively associated with the crankshaft for splashing a lubricating oil stored in the oil reservoir chamber to produce an oil mist, so that with any operative position of the engine, the lubricating oil in the oil reservoir can be splashed (see Japanese Patent Application No. 7-327665).

In the above proposed system, however, the oil slinger is comprised of two pairs of larger and smaller splashing blades to enable the lubricating oil in the oil reservoir chamber to be splashed with any operative position of the engine. For this reason, there is a problem that the structure is complicated, resulting in an increase in cost.

SUMMARY OF THE INVENTION

Accordingly, it is an object of the present invention to provide a system for producing a lubricating oil mist in an engine, wherein an oil slinger having a simple structure enables a lubricating oil in an oil reservoir chamber to be effectively splashed with any operative position of the engine.

To achieve the above object, according to the present invention, there is provided a system for producing a lubricating oil mist in an engine, comprising an oil reservoir chamber provided in an engine body, an oil slinger secured to a crankshaft or a rotary shaft operatively associated with the crankshaft for splashing a lubricating oil stored in the oil reservoir chamber to produce an oil mist, wherein the oil reservoir chamber is defined into a tubular shape having, at opposite ends thereof, annular corner portions with a center thereof being provided by a rotational axis of the oil slinger, and the oil slinger is comprised of a boss fitted over the crankshaft or the rotary shaft operatively associated with the crankshaft, two splashing blades extending from the boss with their tip ends being in proximity to one of the corner portions of the oil reservoir chamber and the other corner portion, so that even with any operative position of the engine, the lubricating oil within the oil reservoir chamber is splashed by at least one of the splashing blades.

With such feature of the present invention, the lubricating oil in the oil reservoir can be always reliably splashed by only the two splashing blades to produce a good oil mist. This can contribute to a good lubrication of the engine with a simple structure at all times.

According to a second aspect and feature of the present invention, in addition to the above feature, the oil reservoir chamber is formed into a non-stepped cylindrical shape, and the two splashing blades of the oil slinger are formed into a point-symmetrical shape.

With such feature of the present invention, the fabrication of the oil reservoir chamber and the oil slinger can be facilitated by making the shapes of the oil reservoir chamber and the oil slinger simple, thereby providing a reduction in cost.

According to a third aspect and feature of the present invention, in addition to the first and second feature, the oil reservoir chamber communicates through a passage means with another chamber requiring the oil mist produced in the oil reservoir chamber, and the passage means has an inlet disposed at a substantially central portion of the oil reservoir chamber, so that even with any operative position of the engine, the inlet is not submerged in the lubricating oil.

With such feature of the present invention, with any operative position of the engine, it is possible to simply prevent the non-misted lubricating oil in the oil reservoir chamber from flowing into the other chamber.

According to a fourth aspect and feature of the present invention, in addition to the third feature, the passage means is comprised of a through-hole provided in the shaft carrying the boss of the oil slinger.

With such feature of the present invention, the oil mist can be supplied from the oil reservoir chamber to the other chamber by a simple structure without use of an exclusive communication pipe.

According to a fifth aspect and feature of the present invention, in addition to the first, second, third or fourth feature, the system further includes an oil return chamber to which the oil mist is returned after performing the lubrication and being liquefied and which communicates through the passage means with the oil reservoir chamber, an outlet of the passage means being disposed at a substantially central portion of the oil reservoir chamber, so that the outlet is not submerged in the lubricating oil with any operative position of the engine.

With such feature of the present invention, with any operative position of the engine, it is possible to simply prevent the non-misted lubricating oil in the oil reservoir chamber from reversely flowing into the oil return chamber.

The above and other objects, features and advantages of the invention will become apparent from the following description of the preferred embodiments taken in conjunction with the accompanying drawings.

DETAILED DESCRIPTION OF THE PREFERRED EMBODIMENTS

The present invention will now be described by way of embodiments with reference to the accompanying drawings.

A first embodiment of the present invention shown in FIGS. 1 to 10 will now be described.

Figure 1:
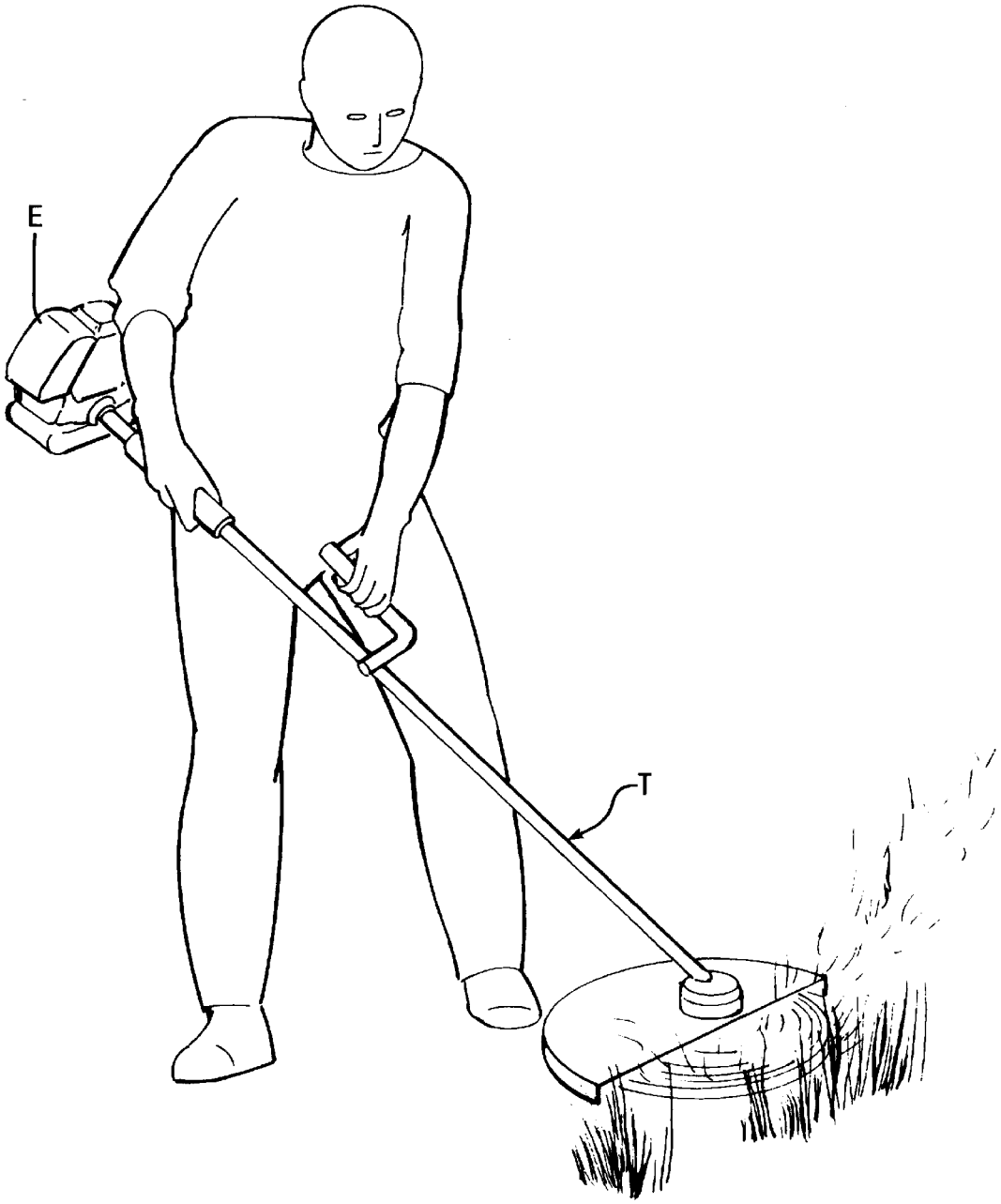
FIG. 1 is a view illustrating the service state of a power trimmer equipped with an engine according to a first embodiment of the present invention.

Referring to FIG. 1, a 4-cycle-engine E of a hand-held type is mounted as a power source, for example, for a power trimmer T, to a drive portion thereof. The power trimmer T is used with a cutter being turned with any of various directions depending upon the working state and hence, at each time, the engine E is also largely inclined or turned upside-down. Thus, the operative position of the engine E is not fixed.

Figure 2:
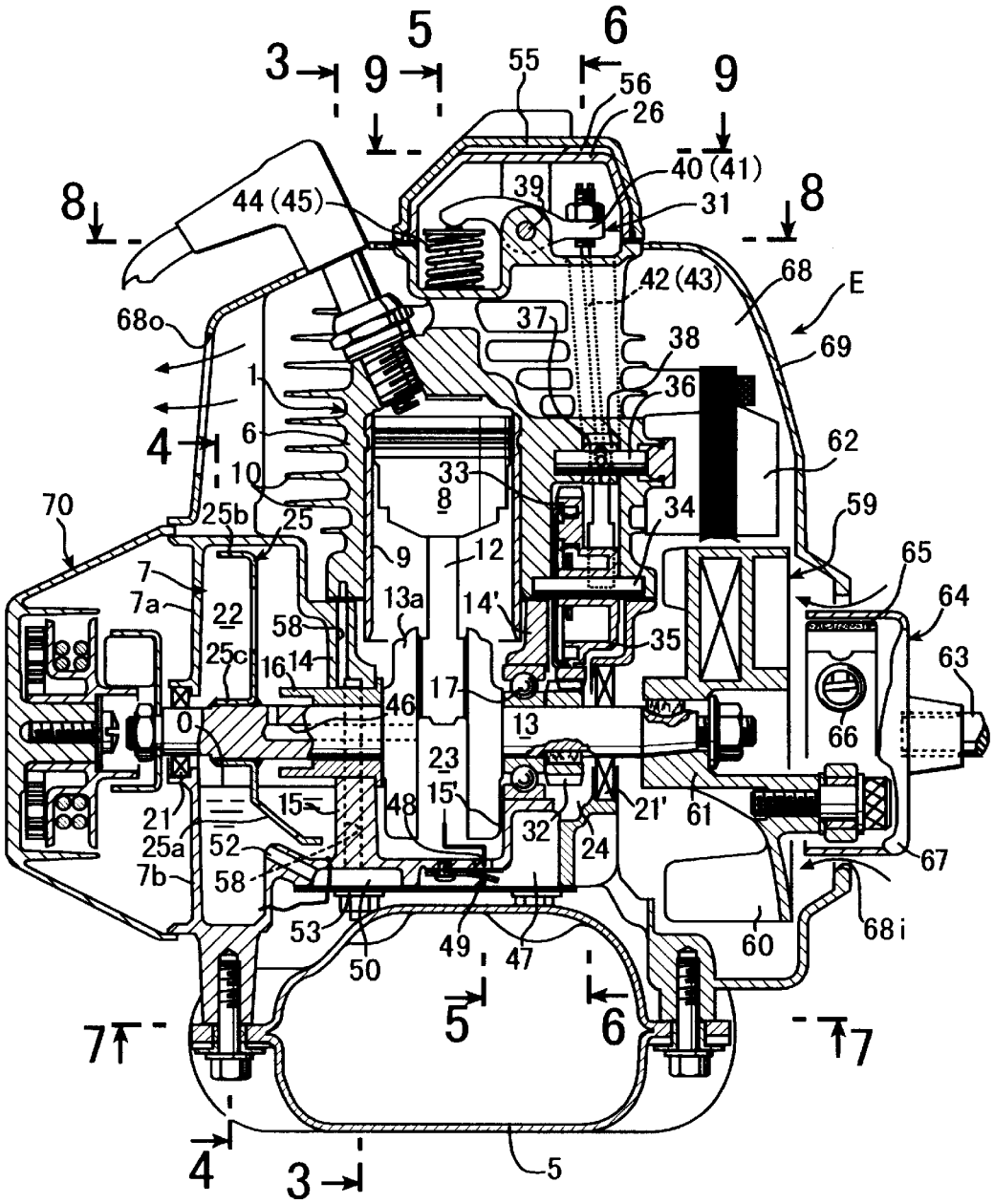
FIG. 2 is a vertical sectional front view of the engine.
Figure 3:
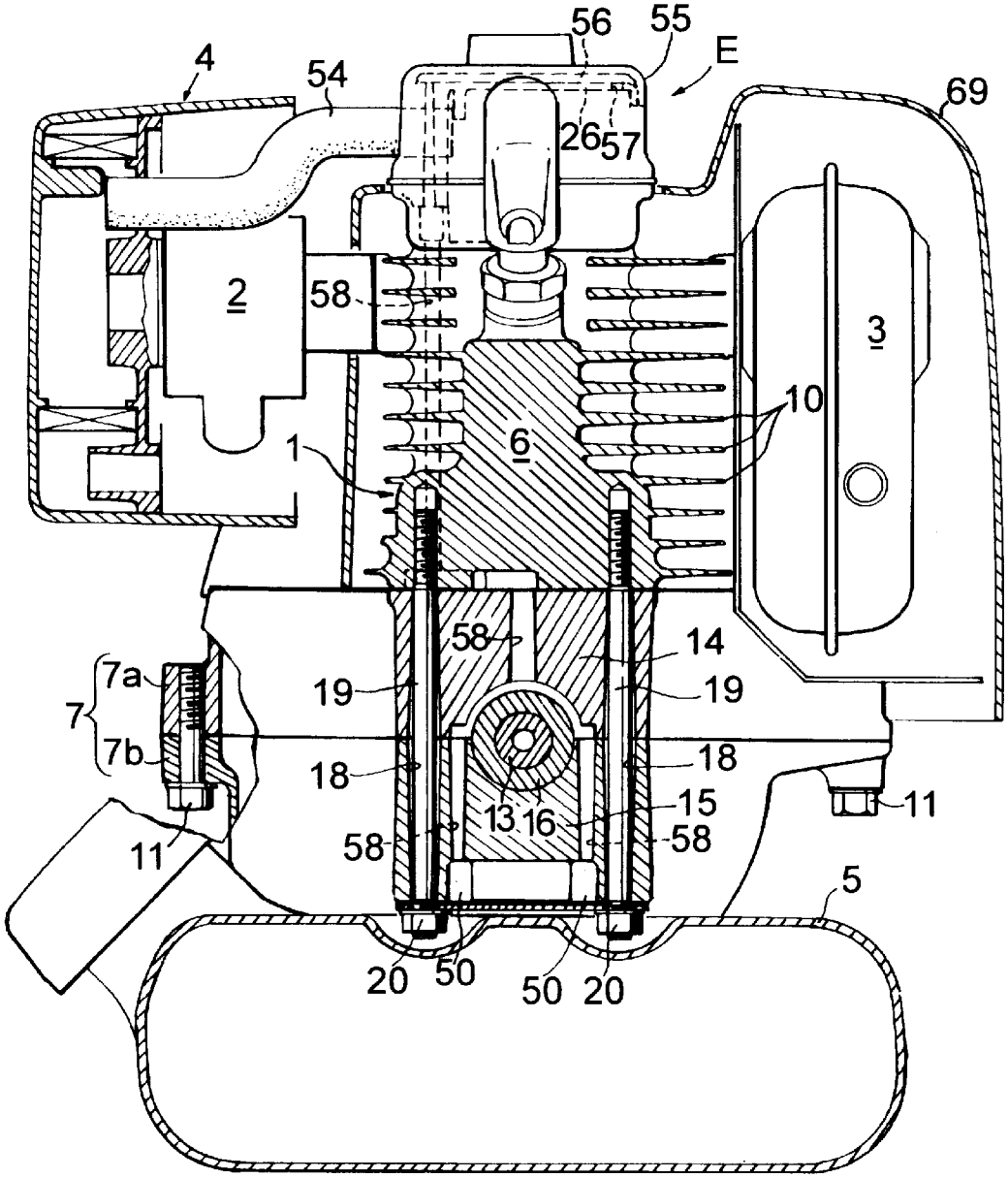
FIG. 3 is a sectional view taken along a line 3—3 in FIG. 2.

Referring to FIGS. 2 and 3, a carburetor 2 and an exhaust muffler 3 are mounted on a front and rear portion of an engine body 1 of the engine E respectively, and an air cleaner 4 is mounted at an inlet of an intake passage in the carburetor 2. A fuel tank 5 is mounted on a lower surface of the engine body 1. The carburetor 2 includes a diaphragm pump for pumping a fuel from the fuel tank 5 by utilizing a pressure pulsing in a crank chamber (which will be described later) in the engine E, so that an extra fuel is circulated to the tank 5. With any position of the engine, the fuel can be supplied to an intake port of the engine E.

Referring to FIGS. 2 and 3, the engine body 1 is comprised of a head-integral type cylinder block 6, and a crankcase 7 bonded to a lower end face of the cylinder block 6. The cylinder block 6 is provided at its central portion with a single cylinder 9 having a piston 8 accommodated therein, and has a large number of cooling fins 10 provided around an outer periphery thereof.

The crankcase 7 is comprised of a pair of upper and lower case halves 7*a* and 7*b* coupled to each other by a plurality of bolts 11 arranged in peripheral edges of the case halves. A crankshaft 13 connected to the piston 8 through a connecting rod 12 is supported in the following manner between both the case halves 7*a* and 7*b*.

The upper case half 7*a* has a pair of left and right upper journal walls 14 and 14' integrally provided thereon and pending from a ceiling wall of the upper case half. The lower case half 7*b* has a pair of left and right lower journal supporting walls 15 and 15' integrally provided thereon, so that they are risen from a bottom wall thereof and opposed to the upper journal walls 14 and 14'. A left journal portion of the crankshaft 13 is clamped by the left upper and lower journal supporting walls 14 and 15 through a plane bearing 16, and a right journal portion of the crankshaft 13 is clamped by the right upper and lower journal supporting walls 14' and 15' through a ball bearing 17. A total of four bolt bores 18 are provided in the upper and lower journal supporting walls 14, 14', 15 and 15', so that they are arranged with the plane bearing 16 or the ball bearing 17 interposed therebetween and are vertically passed through the crankcase 7. Four stud bolts 19 are embedded in the lower end face of the cylinder block 6 and passed through the bolt bores 18. A nut 20 is threadedly fitted over that lower end of each of the stud bolts 19 which protrudes from the lower surface of the crankcase 7. Thus, the upper and lower journal supporting walls 14, 14', 15 and 15' are coupled to each other, and the cylinder block 6 and the crankcase 7 are also coupled to each other.

Such a coupling structure does not interfere with the cooling fins 10 on an outer periphery of the cylinder block 6 in any way. Therefore, the number, extent and the like of the cooling fins 10 can be freely selected, and the air-cooling effect for the engine E can be sufficiently enhanced. In addition, the support rigidity of supporting of the crankcase 7 to the crankshaft 13 can be also enhanced.

Oil seals 21 and 21' are mounted to opposite end walls of the crankcase 7 at its portions through which the crankshaft 13 is passed.

The inside of the crankcase 7 is divided by the upper and lower journal supporting walls 14, 14', 15 and 15' into a left oil reservoir chamber 22, a central crank chamber 23 and a right valve operating chamber 24, as viewed in FIG. 2. The crank portion 13*a* of the crankshaft 13 is disposed in the crank chamber 23. The oil reservoir chamber 22 is defined into a stepped cylindrical configuration or a polygonal tubular configuration having a smaller-diameter annular corner portion 22*a* provided at an end thereof adjacent to the crank chamber 23 and a larger-diameter annular corner portion 22*b* provided at the opposite end. A defined amount of a lubricating oil O is stored in the oil reservoir chamber 22, and an oil slinger 25 for splashing the lubricating oil is secured to the crankshaft 13.

Figure 4:
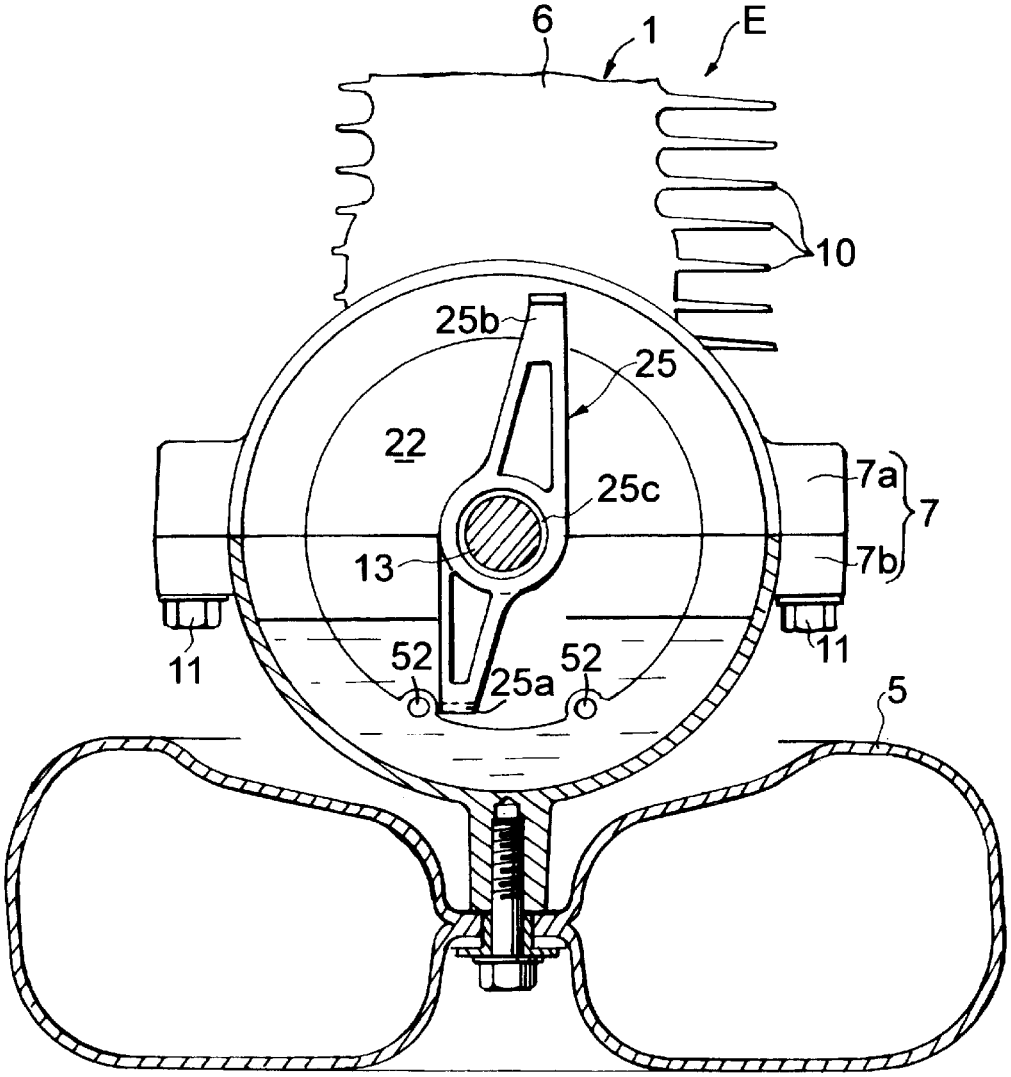
FIG. 4 is a sectional view taken along a line 4—4 in FIG. 2.

As shown in FIGS. 2 and 4, the oil slinger 25 is comprised of a boss 25*c* fitted over the crankshaft 13, and two splashing blades 25*a* and 25*b* extending in radially opposite directions from an outer periphery of the boss 25*c*. A tip end of one of the splashing blades 25*a* is bent to come close to the smaller-diameter corner portion 22*a*, and a tip end of the other splashing blade 25*b* is bent to come close to the larger-diameter corner portion 22*b*. Thus, if the oil slinger 25 is rotated by the crankshaft 13, at least any one of the splashing blades 25*a* and 25*b* of the oil slinger 25 can splash the lubricating oil O in the oil reservoir chamber 22 to always produce an oil mist, with any operative position of the engine.

The valve operating chamber 24 extends through one side of the cylinder block 6 to a head of the cylinder block 6, and has an upper portion which is capable of being opened and closed by a head cover 26 coupled to the head of the cylinder block 6.

Figure 5:
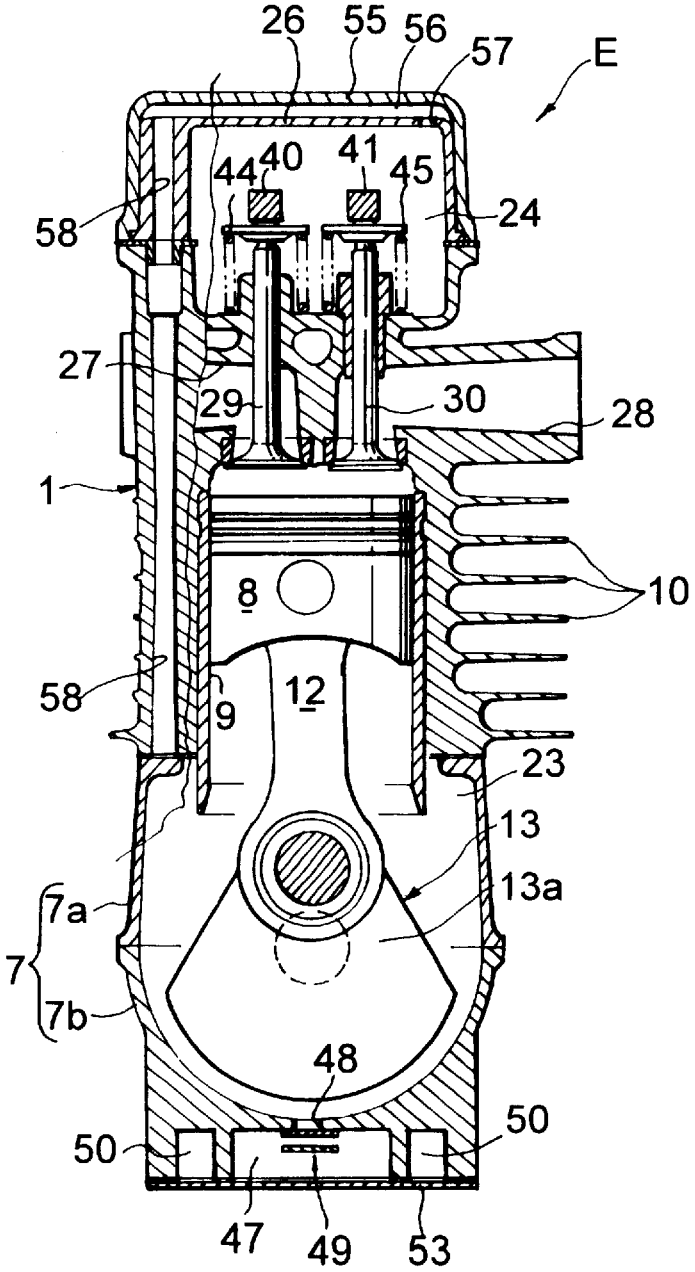
FIG. 5 is a sectional view taken along a line 5—5 in FIG. 2.
Figure 6:
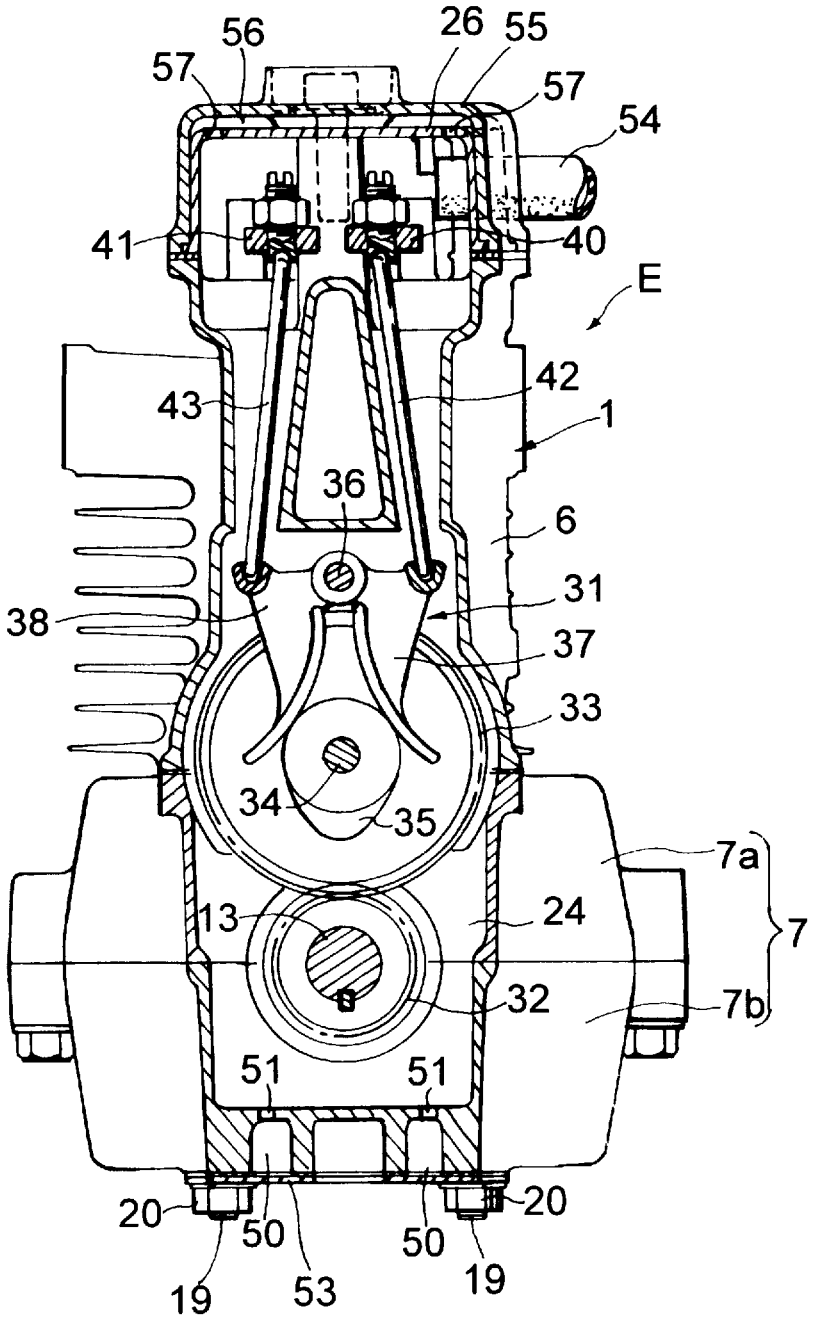
FIG. 6 is a sectional view taken along a line 6—6 in FIG. 2.

As shown in FIGS. 2 and 5, intake and exhaust ports 27 and 28 are defined in the head of the cylinder block 6 and connected to the carburetor 2 and the exhaust muffler 3, and intake and exhaust valves 29 and 30 are also provided in the head of the cylinder block 6 and adapted to the open and close the intake and exhaust ports 27 and 28, respectively. A valve operating device 31 is disposed in the valve operating chamber 24 for opening and closing the intake and exhaust valves 29 and 30.

The valve operating device 31 is comprised of a driving timing gear 32 secured to the crankshaft 13, a driven timing gear 33 which is rotatably carried on a support shaft 34 supported between the coupled surfaces of the cylinder block 6 and the crankcase 7 and which is driven at a deceleration rate of one half from the driving timing gear 32, a cam 35 integrally connected to one end of the driven timing gear 33, a pair of cam followers 37 and 38 carried on a cam follower shaft 36 mounted in the cylinder block 6, so that it is swung by the cam 35, a pair of rocker arms 40 and 41 supported by a rocker shaft 39 mounted in the head of the cylinder block 6 with their one ends put into abutment against valve heads of the intake and exhaust valves 29 and 30, respectively, a pair of push rods 42 and 43 which connect the cam followers 37 and 38 to the other ends of the rocker arms 40 and 41, respectively, and valve springs 44 and 45 for biasing the intake and exhaust valves 29 and 30 in closing directions, respectively. The valve operating device 31 is capable of opening the intake valve 29 during an intake stroke of the piston 8 and opening the exhaust valve 30 during an exhaust stroke of the piston 8.

The oil reservoir chamber 22 and the crank chamber 23 communicate with each other through a through-hole 46 provided in the crankshaft 13. In this case, an opening of the through-hole 46 into the oil reservoir chamber 22 is disposed at a center portion of the chamber 22, and the amount of lubricating oil O stored in the chamber 22 is set such that the opening is not submerged into the oil with any inclined or inverted state of the engine E.

Figure 7:
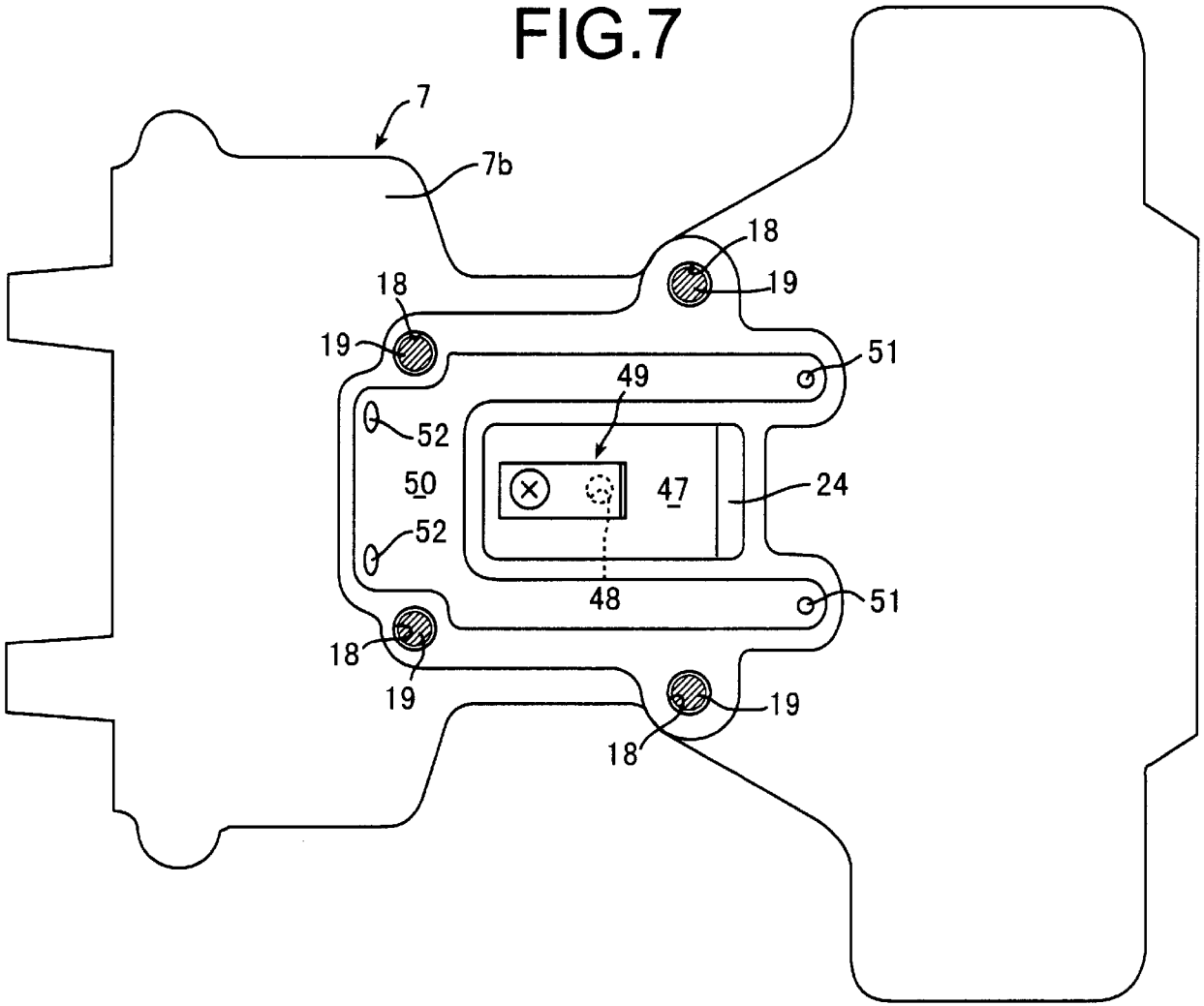
FIG. 7 is a sectional view taken along a line 7—7 in FIG. 2.

As shown in FIGS. 2 and 7, a valve chamber 47 is defined in a lower surface of the crankcase 7 and connected to the valve operating chamber 24. The valve chamber 47 communicates with a bottom portion of the crank chamber 23 through a valve bore 48. A one-way valve 49 as a control valve is mounted in the valve chamber 47 for opening and closing valve bore 48 and is moved in response to the pressure pulsing in the crank chamber 23, so that it closes the valve bore 48 upon a reduction in pressure and opens the valve bore 48 upon an increase in pressure.

A U-shaped oil return chamber 50 is defined in the lower surface of the crankcase 7 to surround the valve chamber 47 as shown in FIG. 7. The oil return chamber 50 communicates with the bottom of the valve operating chamber 24 through a pair of orifices 51 disposed at a distance spaced apart from each other to the utmost, and also communicates with the oil reservoir chamber 22 through a pair of through-holes 52. The total sectional area of the pair of through-holes 52 is set sufficiently larger than the total sectional area of the orifices 51.

The valve chamber 47 and the oil return chamber 50 are defined by closing a recess defined in the lower surface of the crankcase 7 by a bottom plate 53. The bottom plate 53 is clamped to the crankcase 7 by the stud bolt 19 and the nut 20.

An upper portion of the valve operating chamber 24 communicates with the inside of the air cleaner 4 through a breather tube 54 made of a rubber and mounted in one side wall of the head cover 26 to penetrate such one side wall. In this case, that end of the breather tube 54 which opens into the valve operating chamber 24 is disposed to protrude a predetermined length into the valve operating chamber 24. Therefore, even with any operative position of the engine E, it is possible to prevent the oil accumulated in some amount in the valve, operating chamber 24 from flowing into the breather tube 54.

Figure 8:
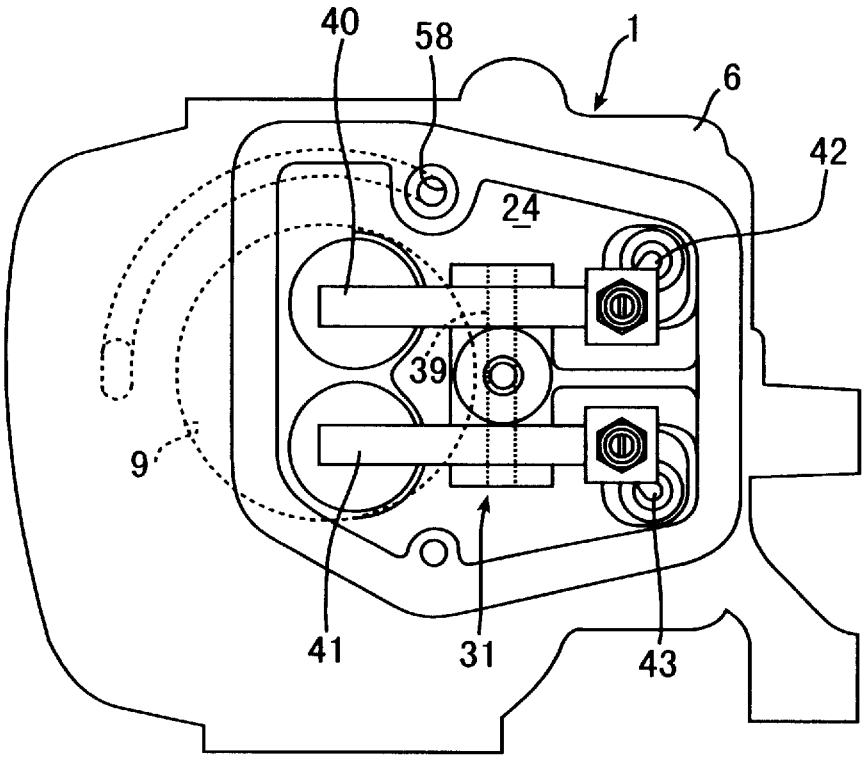
FIG. 8 is a sectional view taken along a line 8—8 in FIG. 2.
Figure 9:
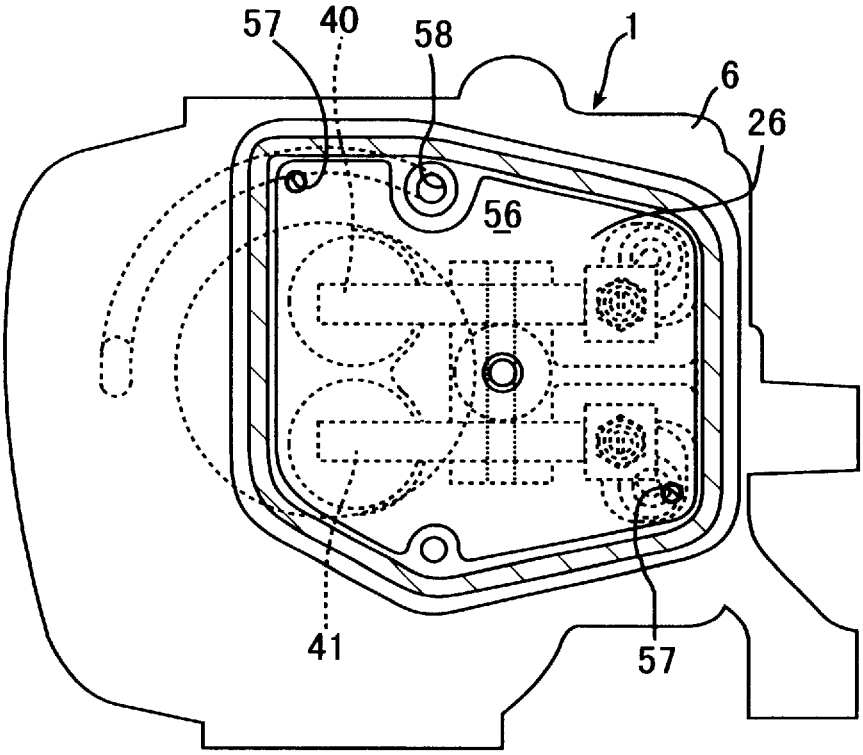
FIG. 9 is a sectional view taken along a line 9—9 in FIG. 2.

As shown in FIGS. 2, 8 and 9, an outer cover 55 is coupled to the head cover 26 and fitted over an outer periphery of the head cover 26. A flat uppermost chamber 56 is defined between ceiling walls of the covers 25 and 55 and communicates with the valve operating chamber 24 through a pair of orifices 57 provided in diagonal locations in the coiling wall of the head cover 26 (desirably at four corners). The uppermost chamber 56 also communicates with the oil return chamber 50 through a single oil passage 58 provided in the cylinder block 6 and the crankcase 7. The oil passage 58 has a sectional area larger than the total sectional area of the pair of orifices 57.

Figure 10A:
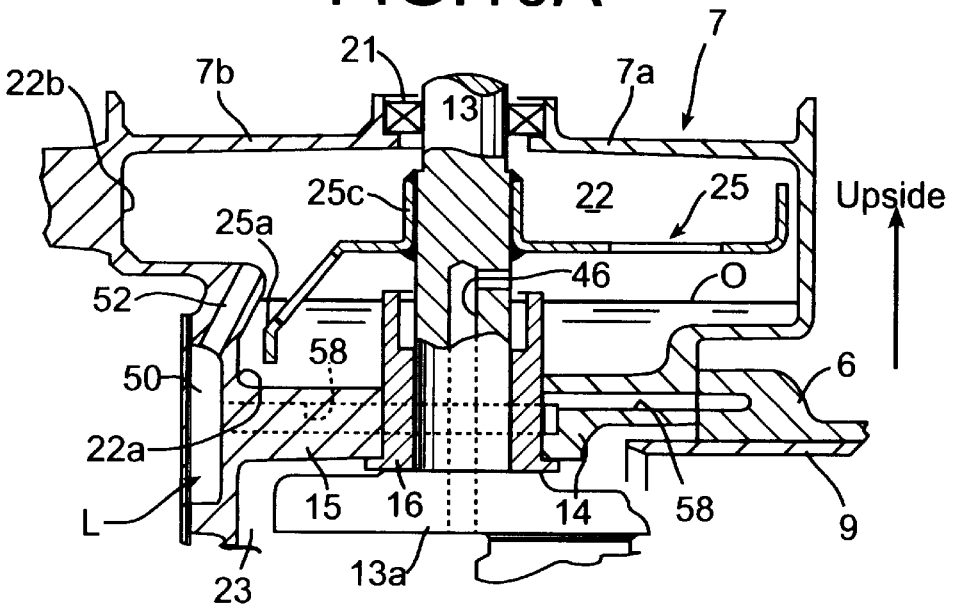
FIG. 10A is a sectional view showing the positional relationship between the level of an oil stored in an oil reservoir chamber and a circulation flow passageway in a sideways-fallen-down state of the engine.
Figure 10B:
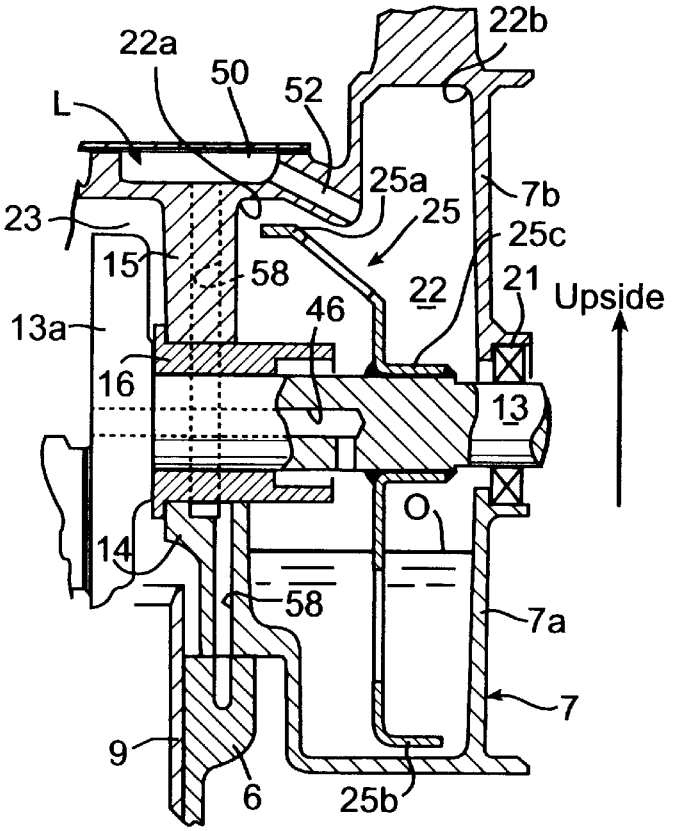
FIG. 10B is a sectional view showing the positional relationship between the level of the oil stored in an oil reservoir chamber and the circulation flow passageway in an inverted state of the engine.

As can be seen from the above description, the orifices 51 and 57 and the uppermost chamber 56, the oil passage 58, the oil return chamber 50 and the through-holes 52 constitute a circulation flow passageway L for returning the lubricating oil from the valve operating chamber 24 to the oil reservoir chamber 22. An opening of the circulation flow passageway L into the oil reservoir chamber 22, i.e., an outlet end of the through-hole 52 is disposed at a longitudinally and laterally central portion of the oil reservoir chamber 22 and below a vertically central portion of the oil reservoir chamber 22. Thus, in a sideways-fallen-down or inverted state of the engine E in which the valve chamber 24 is located below the oil reservoir chamber 22, as shown in FIGS. 10A and 10B, the opening is exposed above the level of the oil stored in the oil reservoir chamber 22.

If the oil slinger 25 allows the lubricating oil O to splash in the oil reservoir chamber 22 by the rotation of the crankshaft 13 to produce the oil mist during operation of the engine E, the oil mist is sucked into the crank chamber 23 through the through-hole 46 when the pressure in the crank chamber 23 is decreased because of the rising movement of the piston 8, thereby lubricating the crank portion 13*a* and a section around the piston 8. When the pressure in the crank chamber 23 is then increased by the lowering movement of the piston 8, the oil mist is supplied to the valve chamber 47 and thus to the valve operating chamber 24 along with a blow-by gas generated in the crank chamber 23 as a result of opening of the one-way valve 49, and the oil mist and the blow-by gas are separated from each other in the chamber 24. Then, the oil mist lubricates various portions of the valve operating device 31, and the blow-by gas is discharged through the breather tube 54 to the air cleaner 4.

The pressure in the crank chamber 23 is pulsed by rising and lowering movements of the piston 5 so that it assumes a positive value and a negative value alternatively and repetitively. When the pressure assumes the positive value, the one-way valve 49 is opened to permit the positive pressure to be released to the valve chamber 47. When the pressure assumes the negative value, the one-way valve 49 is closed to inhibit the reverse flow of the positive pressure from the valve chamber 47. Therefore, the pressure in the crank chamber 23 is maintained averagely at a negative level.

On the other hand, the valve operating chamber 24 and the valve chamber 47 communicating with each other communicate with the inside of the air cleaner 4 which is in an atmospheric pressure state, through the breather tube 54 and hence, the pressures in both the chambers 24 and 417 are substantially equal to the atmospheric pressure.

The oil reservoir chamber 22 communicates with the crank chamber 23 through the through-hole 46 and hence, the pressure in the oil reservoir chamber 22 is a pressure equal to or slightly higher than the pressure in the crank chamber 23.

The oil return chamber 50 communicates with the oil reservoir chamber 22 through the through-hole 52 and also communicates with the valve operating chamber 24 through the orifices 51 and hence, the pressure in the oil return chamber 50 is a pressure equal to or slightly higher than the pressure in the oil reservoir chamber 22.

The uppermost chamber 56 communicates with the oil return chamber 50 through the oil passage 58 and also communicates with the valve operating chamber 24 through the orifices 57 and hence, the pressure in the uppermost chamber 50 is a pressure equal to or slightly higher than the pressure in the oil return chamber 50.

The level relationship between the pressures in the chambers can be represented by the following expression:

$$Pc \leqq Po \leqq Pr \leqq Pt < Pv$$

wherein

Pc: pressure in the crank chamber 23

Po: pressure in the oil reservoir chamber 22

Pr: pressure in the oil return chamber 50

Pt: pressure in the uppermost chamber 56

Pv: pressure in the valve operating chamber 24

As a result, the pressure flows in the following course during operation of the engine:

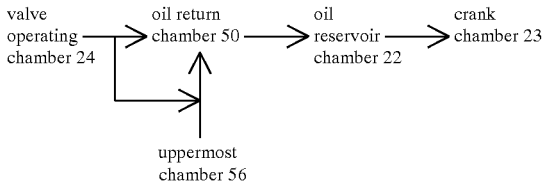

Therefore, the oil mist fed to the valve operating chamber 24 circulates through the above-described pressure course to the oil reservoir chamber 22, and the oil liquefied in the valve operating chamber 24 circulates via the orifices 51 to the oil return chamber 50 and the oil reservoir chamber 22. Thus, the circulation of the oil mist and the liquefied oil is performed without any hindrance with any inclined state of the engine E.

In the inverted operative state of the engine E, the uppermost chamber 56 lies below the valve operating chamber 24 and hence, the oil liquefied in the valve operating chamber 24 flows through the orifices 57 into the uppermost chamber 24, and drawn through the oil passage 58 into the oil return chamber 50 to circulate into the oil reservoir chamber 22.

In this way, with any operative position such as the inclined and inverted positions of the engine E, the circulation of the lubricating oil within the engine E can be performed continually, thereby constantly ensuring a good lubricated state. Therefore, the engine can withstand the working of the power trimmer T in all directions. Moreover, since the pressure pulsing in the crank chamber 23 is utilized for the circulation of the lubricating oil, an expensive oil pump is not required.

When the operation of the engine E is stopped after the working to leave the power trimmer to stand, the engine E may be fallen down sideways or put into a inverted state in some cases, as shown in FIGS. 10A and 10B. In such a state, however, the opening of the circulation oil passageway L connected to the valve operating chamber 24 into the oil reservoir chamber 22, i.e., the outlet end of the through-hole 52 is exposed above the level of the lubricating oil O within the oil reservoir chamber 22 and hence, it is possible to prevent the lubricating oil O within the oil reservoir chamber 22 from reversely flow through the circulation oil passageway L into the valve operating chamber 24. Therefore, the leakage of the lubricating oil from the valve operating chamber 24 to the breather tube 54 can be previously avoided.

Referring again to FIG. 2, a rotor 61 of a flywheel magneto 59 having a cooling blade 60 is secured to an outer end of the crankshaft 13 adjacent to the valve operating chamber 24, and an ignition coil 62 cooperating with the rotor 61 is secured to the cylinder block 6. A centrifugal clutch 64 is interposed between the rotor 61 and a drive shaft 63 for a working machine. The centrifugal clutch 64 is comprised of a plurality of clutch shoes 65 expandably carried on the rotor 61, a clutch spring 66 for biasing the clutch shoes 65 in a contracting direction, and a clutch drum 67 secured to the drive shaft 63 to surround the clutch shoes 65. If the rotor 61 is rotated in a predetermined number of rotations or more, the clutch shoes 65 are expanded into pressure contact with an inner peripheral surface of the clutch drum 67, thereby permitting an output torque from the crankshaft 13 to be transmitted to the drive shaft 63.

A shroud 69 is mounted to the engine body 1 to cover the head portion of the engine body 1 and tile flywheel magneto 59 and to define a cooling air passage 68 between the shroud 69 and the engine body 1. An inlet 68*i* of the passage 68 is provided in an annular configuration between the centrifugal clutch 64 and the shroud 69, and an outlet 68*o* is provided in the shroud 69 at a location opposite from the inlet 68*i*.

Thus, during rotation of the rotor 61, wind produced by the cooling blade 60 flows through the cooling air passage 68 to cool various portions of the engine E.

A known recoiled starter 70 capable of cranking the crankshaft 13 is mounted to the outer side of the crankcase 7 adjacent to the oil reservoir chamber 22. The starter 70 is disposed to protrude from an outer surface of the shroud 69 from the viewpoint of the operability thereof. By the fact that the starter 70 is disposed outside and adjacent to the oil reservoir chamber 22, a dead space cannot be created inside the starter 70, which can contribute to the compactness of the engine E.

Figure 11:
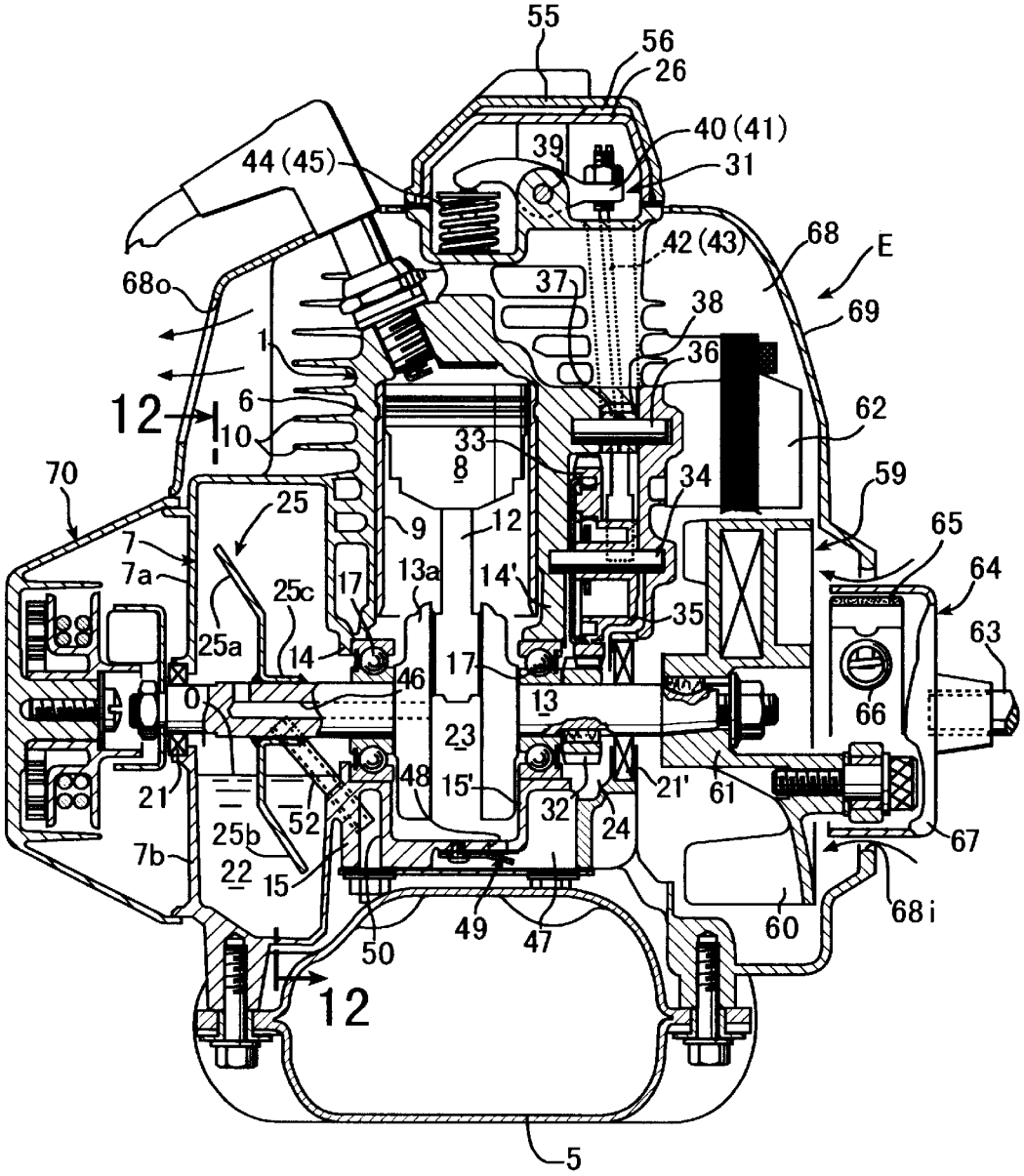
FIG. 11 is a sectional view similar to FIG. 2, but according to a second embodiment of the present invention.
Figure 12:
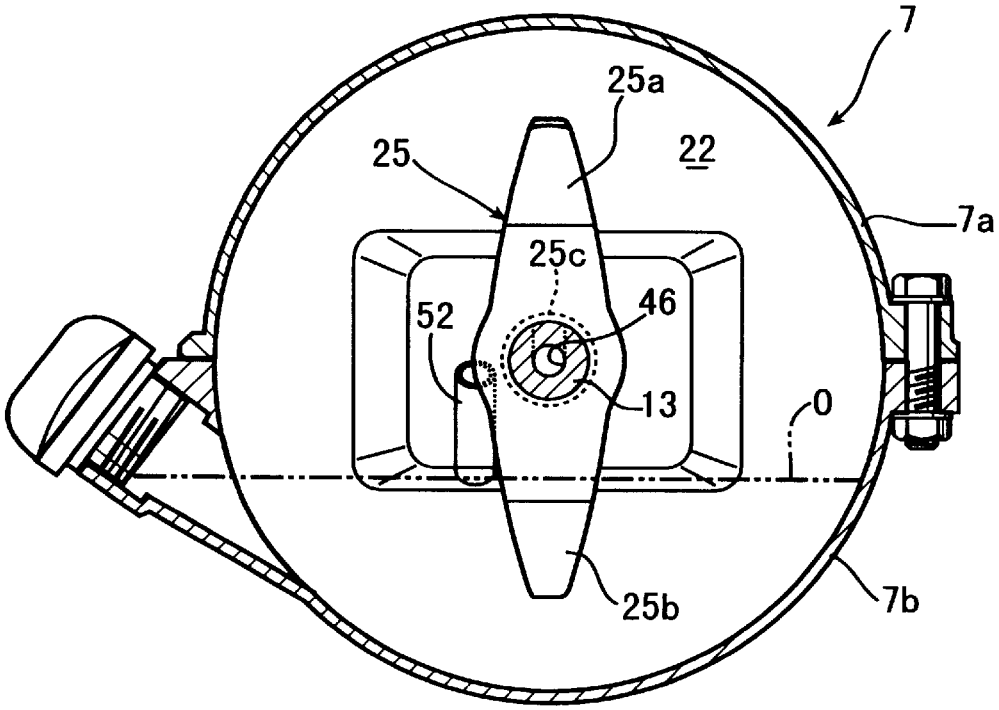
FIG. 12 is a sectional view taken along a line 12—12 in FIG. 11.

FIGS. 11 and 12 Illustrate a second embodiment of the present invention. The differences from the above-described embodiment are that the left journal portion of the crankshaft 13 is supported by a ball bearing 17 similar to that for the right journal portion; that the oil reservoir chamber 22 is defined in a non-stepped cylindrical shape, and two splashing blades 25*a* and 25*b* of the oil slinger 25 are formed in a point symmetrical shape such that their tip ends are in proximity to corner portions at opposite ends of the oil reservoir chamber 22; and that the oil return chamber 50 and the oil reservoir chamber 22 are put into communication with each other by a return pipe 52 fitted in a partition wall therefor. An opened end of the return pipe 52 adjacent to the oil reservoir chamber 22 is located in proximity to the center portion of the oil reservoir chamber 22 to the utmost.

The other constructions are similar to those in the previous embodiment. In FIGS. 11 and 12, portions or components corresponding to those in the previous embodiment are designated by like reference characters, and the description of them is omitted.

According to this embodiment, the durability of a supporting portion for the crankshaft 13 can be enhanced, and the fabrication of the oil slinger 25 can be facilitated by making the shape of the oil slinger 25 simple. Further, the reverse flow of the oil from the oil reservoir chamber 22 through the return pipe 52 to the oil return chamber 50 can be reliably prevented.

Although the present invention has been described in detail, it will be understood that the present invention is not limited to the above-described embodiments, and various modifications may be made without departing from the spirit and scope of the invention defined in claims. For example, the oil slinger 25 may be rotated by another rotary shaft operatively associated with the crankshaft 13.

What is claimed is:

1. A system for producing a lubricating oil mist in an engine, comprising an oil reservoir chamber (22) provided in an engine body (1), an oil slinger (25) secured to a crankshaft (13) or a rotary shaft operatively associated with the crankshaft (13) for splashing a lubricating oil (O) stored in the oil reservoir chamber (22) to produce an oil mist, wherein said oil reservoir chamber (22) is defined into a tubular shape having, at opposite ends thereof, annular corner portions (22*a* and 22*b*) with a center thereof being provided by a rotational axis of the oil slinger (25), and said oil slinger (25) is comprised of a boss (25*c*) fitted over the crankshaft (13) or the rotary shaft operatively associated with the crankshaft (13), two splashing blades (25*a* and 25*b*) extending from said boss (220) with tip ends thereof being positioned in proximity to one of the corner portion (22*a*) of the oil reservoir chamber (22) and the other corner portion (22*b*), wherein with any operative position of the engine (E), the lubricating oil (O) within the oil reservoir chamber (22) is splashed by at least one of said splashing blades (25*a* and 25*b*).

2. A system for producing a lubricating oil mist in an engine according to claim 1, wherein said oil reservoir chamber (22) is formed into a non-stopped cylindrical shape, and said two splashing blades (25*a* and 25*b*) of said oil slinger (25) are formed into a point-symmetrical shape.

3. A system for producing a lubricating oil mist in an engine according to claim 1 or 2, wherein said oil reservoir chamber (22) communicates through a passage means (46) with another chamber (23) that requires the oil mist produced in said oil reservoir chamber (12), and said passage means (46) has an inlet disposed at a substantially central portion of the oil reservoir chamber (22), so that with any operative position of the engine (E), said inlet is not submerged in the lubricating oil (O).

4. A system for producing a lubricating oil mist in an engine according to claim 3, wherein said passage means is comprised of a through-hole (46) provided in the crank shaft (13) carrying the boss of said oil slinger (25).

5. A system for producing a lubricating oil mist in an engine according to claim 1 or 2, further including an oil return chamber (50) to which the oil mist is returned after performing the lubrication and being liquefied, and said oil return chamber (50) communicates through the passage means (52) with the oil reservoir chamber (22), an outlet of said passage means (52) being disposed at a substantially central portion of said oil reservoir chamber (22), so that with any operative position of the engine (E), said outlet is not submerged in the lubricating oil (O).

* * * * *